US011700499B2

(12) United States Patent
Wang et al.

(10) Patent No.: US 11,700,499 B2
(45) Date of Patent: Jul. 11, 2023

(54) ACOUSTIC CONTROL DEVICE

(71) Applicant: HONDA MOTOR CO., LTD., Tokyo (JP)

(72) Inventors: Xun Wang, Wako (JP); Toshio Inoue, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/681,801

(22) Filed: Feb. 27, 2022

(65) Prior Publication Data

US 2022/0303705 A1 Sep. 22, 2022

(30) Foreign Application Priority Data

Mar. 18, 2021 (JP) ..... 2021-044966

(51) Int. Cl.
*H04S 7/00* (2006.01)
*H04R 3/12* (2006.01)

(52) U.S. Cl.
CPC ..... *H04S 7/301* (2013.01); *H04R 3/12* (2013.01); *H04R 2499/13* (2013.01)

(58) Field of Classification Search
None
See application file for complete search history.

(56) References Cited

U.S. PATENT DOCUMENTS

| | | | | |
|---|---|---|---|---|
| 6,980,663 | B1 * | 12/2005 | Linhard | H04R 3/02 381/86 |
| 8,199,923 | B2 * | 6/2012 | Christoph | G10K 11/17881 381/71.4 |
| 9,711,131 | B2 * | 7/2017 | Christoph | H04K 3/825 |
| 10,152,962 | B2 * | 12/2018 | MacNeille | G10K 11/17821 |
| 11,034,211 | B2 * | 6/2021 | Fridman | G10K 11/17883 |
| 11,211,061 | B2 * | 12/2021 | Li | H04R 3/005 |
| 11,575,990 | B2 * | 2/2023 | Herbig | H04R 3/12 |
| 2014/0314256 | A1 * | 10/2014 | Fincham | H04S 7/307 381/303 |
| 2019/0014430 | A1 * | 1/2019 | Christoph | H04S 7/303 |
| 2019/0132668 | A1 | 5/2019 | Seki | |

FOREIGN PATENT DOCUMENTS

JP 2019-083408 A 5/2019

* cited by examiner

*Primary Examiner* — Paul W Huber
(74) *Attorney, Agent, or Firm* — Carrier, Schende & Associates, P.C.; Joseph P. Carrier; Fulchand P. Shende

(57) ABSTRACT

An acoustic control device includes a control signal generating unit configured to perform signal processing on a sound source signal by a control filter, which is an adaptive FIR filter, to generate a control signal that controls speakers, and a control filter updating unit configured to update sequentially and adaptively the control filter in a manner that a difference between a sound pressure in a viewing area and a sound pressure in a quiet area becomes a predetermined level.

5 Claims, 9 Drawing Sheets

ACOUSTIC CONTROL DEVICE

CROSS-REFERENCE TO RELATED APPLICATIONS

This application is based upon and claims the benefit of priority from Japanese Patent Application No. 2021-044966 filed on Mar. 18, 2021, the contents of which are incorporated herein by reference.

BACKGROUND OF THE INVENTION

Field of the Invention

The present invention relates to an acoustic control device.

Description of the Related Art

JP 2019-083408 A discloses a sound reproduction system. The sound reproduction system divides a vehicle compartment into a first region to a fourth region, and simultaneously outputs from speakers a first sound to be heard in the first region and a second sound to be heard in other regions. The sound reproduction system includes a first control filter and a second control filter. The first control filter is set to have a control characteristic in which the sound pressure of the first sound output from the speaker in each of other regions is lower than the sound pressure of the first sound output from the speaker in the first region. The second control filter is set to have a control characteristic in which the sound pressure of the second sound output from the speaker in each of the other regions is higher than the sound pressure of the second sound output from the speaker in the first region.

SUMMARY OF THE INVENTION

In the sound reproduction system disclosed in JP 2019-083408 A, the control filter is fixed. Therefore, when the sound field characteristic in the vehicle compartment changes, there is concern that the sound reproduction system cannot perform appropriate control.

An object of the present invention is to solve the above-described problems.

According to an aspect of the present invention, an acoustic control device controls a plurality of speakers in order for a sound pressure in a quiet area to become lower than a sound pressure in a viewing area, based on a sound source signal output from a sound source, and the acoustic control device includes sound detectors each configured to detect a sound in an installed area and output a detection sound signal, at least one of the sound detectors installed in the viewing area and at least one of the sound detectors installed in the quiet area, a control signal generating unit configured to perform signal processing on the sound source signal by a control filter, which is an adaptive finite impulse response filter, to generate a control signal that controls the speakers, a sound field characteristic learning unit configured to learn as a sound field filter a sound field characteristic between the speakers and the sound detectors, a reference signal generating unit configured to perform signal processing on the sound source signal by the sound field filter to generate a reference signal, and a control filter updating unit configured to update sequentially and adaptively the control filter based on the reference signal and the detection sound signal in a manner that a difference between the sound pressure in the viewing area and the sound pressure in the quiet area becomes a predetermined level.

The acoustic control device according to the present invention can perform appropriate control even when the sound field characteristic in the vehicle compartment has changed.

The above and other objects, features, and advantages of the present invention will become more apparent from the following description when taken in conjunction with the accompanying drawings, in which a preferred embodiment of the present invention is shown by way of illustrative example.

DESCRIPTION OF THE INVENTION

First Embodiment

Figure 1:
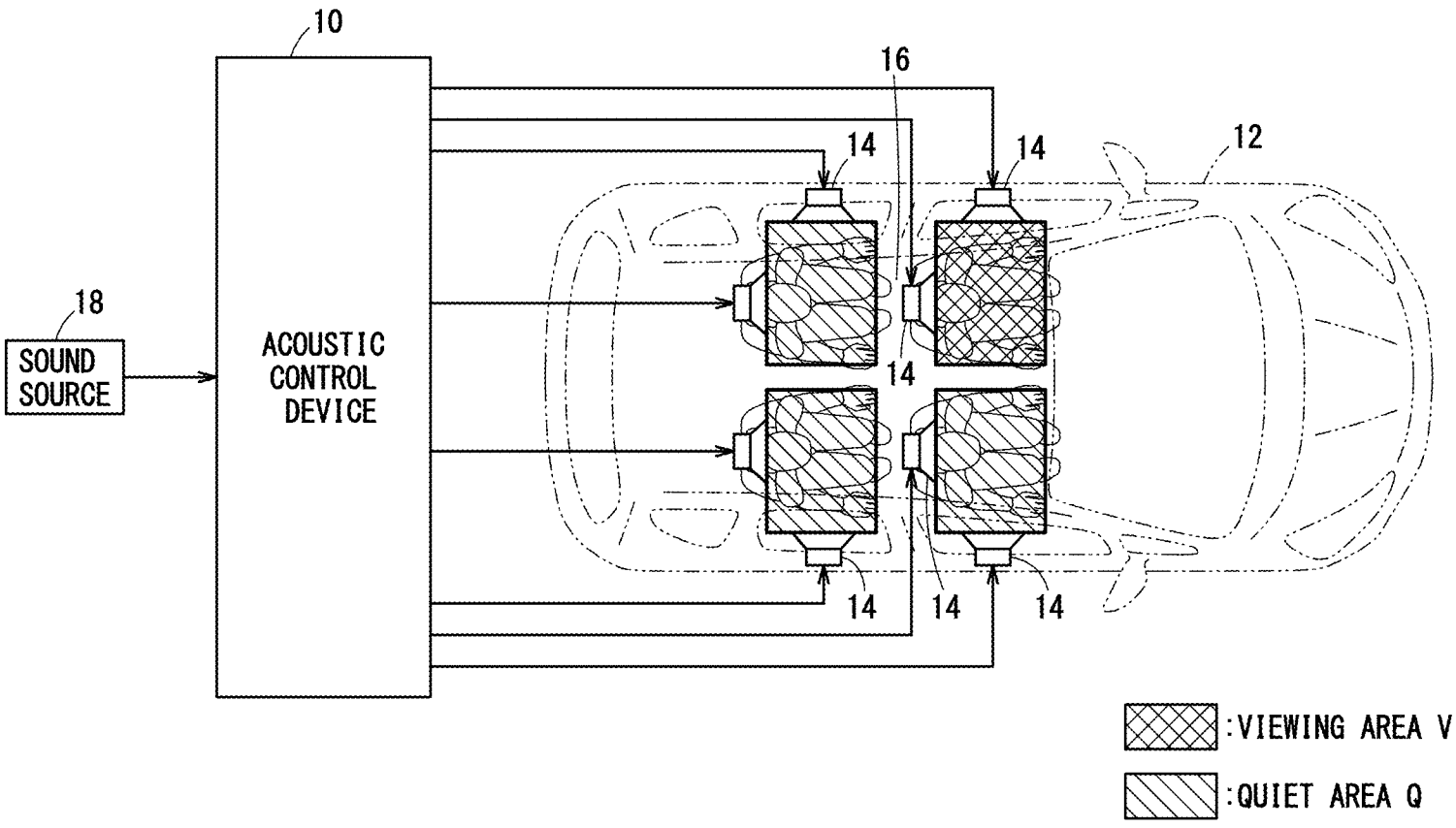
FIG. 1 is a diagram illustrating an overview of acoustic control performed by an acoustic control device.

FIG. 1 is a diagram illustrating an overview of sound control performed by an acoustic control device 10.

The acoustic control device 10 according to the present embodiment controls a plurality of speakers 14 provided in a vehicle 12. As a result, the sound pressure in each area Q set in the vehicle compartment 16 is made lower than the sound pressure in a viewing (looking and listening) area V set in the vehicle compartment 16. As a result, a vehicle occupant in the viewing area V can clearly hear the sound of a sound source 18. On the other hand, the sound of the sound source 18 can be hardly heard by vehicle occupants in the quiet areas Q. The sound source 18 is a device for playing, for example, music, radio broadcasting, television broadcasting, voice guidance of a car navigation system, or the like.

Figure 2:
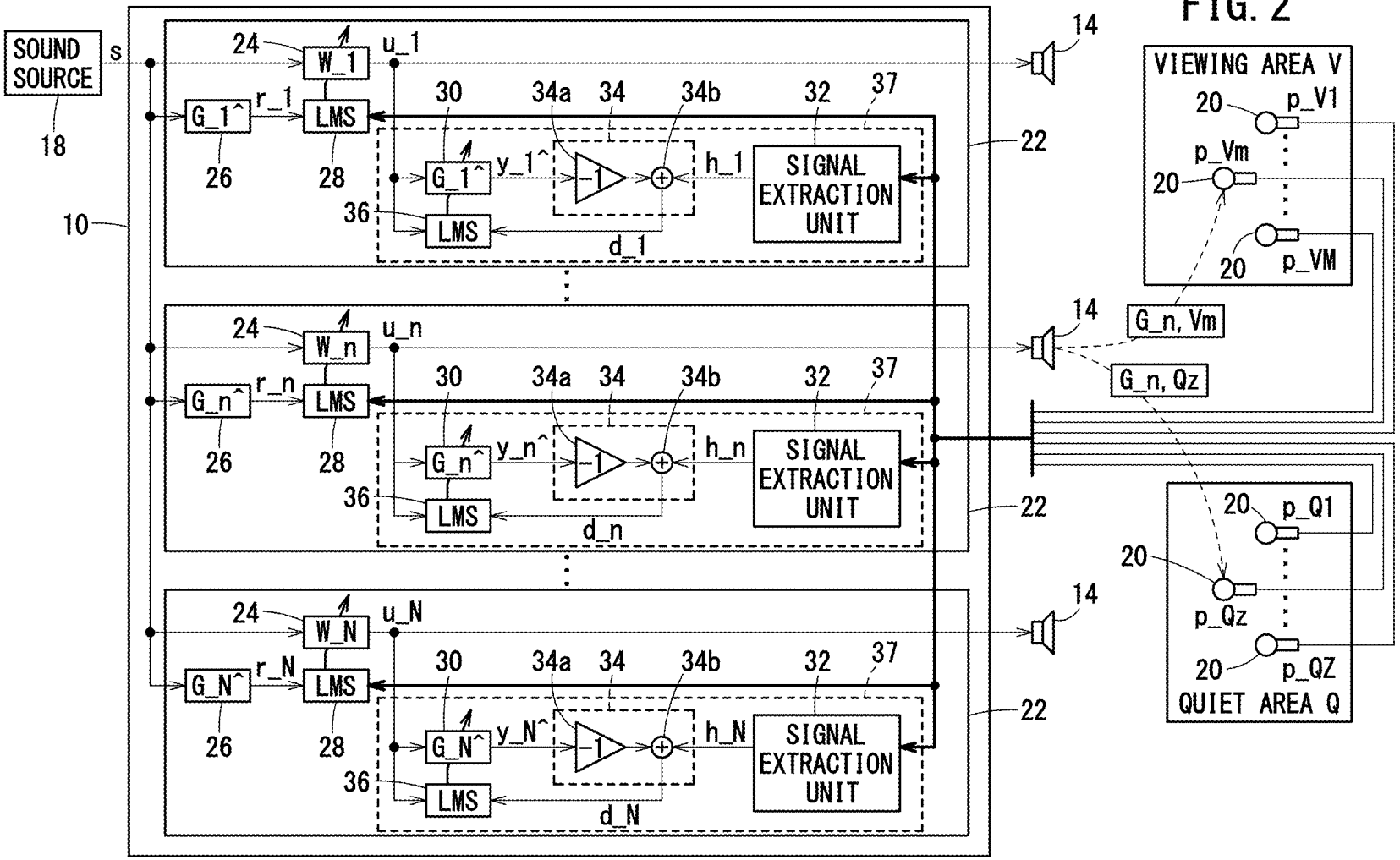
FIG. 2 is a control block diagram of the acoustic control device.

FIG. 2 is a control block diagram of the acoustic control device 10. The acoustic control device 10 controls N speakers 14. Hereinafter, it is assumed that each of the N speakers 14 is assigned a unique number among 1 to N. When the speaker 14 of a specific number is described, for example, it is described as an n-th speaker 14.

Detection sound signals p_V are input to the acoustic control device 10 from M microphones 20 installed in the viewing area V. In addition, detection sound signals p_Q are input to the acoustic control device 10 from Z microphones 20 installed in the quiet areas Q. The microphone 20 corresponds to a sound detector of the present invention.

Hereinafter, it is assumed that a unique number among V1 to VM is assigned to each of the M microphones 20 installed in the viewing area V. When a microphone 20 with a unique number is described, for example, it is described as a Vm-th microphone 20. Similarly, it is assumed that a unique number among Q1 to QZ is assigned to the Z microphones 20 installed in the quiet areas Q. When the microphone 20 with a unique number is described, for example, it is described as a Qz-th microphone 20.

Hereinafter, a sound field characteristic between each speaker 14 and each microphone 20 is denoted by G. For example, it is assumed that sound field characteristic between an n-th speaker 14 and a Vm-th microphone 20 is G_n−Vm. Similarly, a sound field characteristic between the n-th speaker 14 and a Qz-th microphone 20 is denoted by G_n−Qz.

The acoustic control device 10 includes a plurality of signal processing units 22 corresponding to the speakers 14. The respective signal processing units 22 output control signals u_1 to u_N for controlling the respective speakers 14. Each of the signal processing units 22 includes a control signal generating unit 24, a reference signal generating unit 26, a control filter updating unit 28, an estimated detection sound signal generating unit 30, a signal extraction unit 32, a differential signal generating unit 34, and a sound field filter updating unit 36. The estimated detection sound signal generating unit 30, the signal extraction unit 32, the differential signal generating unit 34, and the sound field filter updating unit 36 constitute a sound field characteristic learning unit 37.

Each of the control signal generating units 24 performs signal processing on a sound source signal s input from the sound source 18 using the control filters W_1 to W_N to generate control signals u_1 to u_N. The control filters W_1 to W_N are FIR (Finite Impulse Response) filters. For example, the control filter W_n is denoted by the following vector. T denotes a transposed vector.

$$W_n=[W_n1, W_n2, \ldots, W_nL]^T \tag{1}$$

The sound source signal s can be indicated by the following time series vector. In the expression, t denotes a discrete time.

$$s=[s_t, s_t-1, \ldots, s_t-L+1]^T \tag{2}$$

The reference signal generating units 26 respectively generate reference signals r_1 to r_N by performing signal processing on the sound source signals s input from the sound source 18 using sound field filters G_1^ to G_N^. The sound field filters G_1^ to G_N^ are FIR filters, and the sound field filter G_n^ can be expressed by the following vector.

$$G_n\hat{}=[G_n, V1\hat{}, G_n, V2\hat{}, \ldots, G_n, VM\hat{}, G_n, Q1\hat{}, G_n, Q2\hat{}, \ldots, G_n, Q\hat{}] \tag{3}$$

For example, the element G_n,V1^ of the above vector indicates an identified value of the sound field characteristic G_n,V1 between the n-th speaker 14 and the V1-th microphone 20.

The respective control filter updating units 28 update the control filters W_1 to W_N based on the reference signals r_1 to r_N and the detection sound signals p_V1 to p_VM and p_Q1 to p_QZ detected by the microphones 20. For example, the control filter W_n is updated such that the next evaluation function J is minimized.

$$J = ej^2 = \left(\frac{1}{M}\sum_{m=1}^{M}|\text{p_Vm}| - \frac{1}{Z}\sum_{z=1}^{Z}|\text{p_Qz}| - D\right)^2 \tag{4}$$

When the evaluation function J becomes the minimum (J=0), the difference between the average value of the sound pressure in the viewing area V and the average value of the sound pressure in the quiet areas Q becomes a predetermined target value D.

The detection sound signal p_Vm of the Vm-th microphone 20 in the viewing area V and the detection sound signal p_Qz of the Qz-th microphone 20 in the quiet area Q are expressed by the following expressions. In the following expressions, "*" indicates a convolution operation.

$$\text{p_Vm} = \sum_{n=1}^{N} s * \text{W_n} * \text{G_n}, Vm \qquad \text{p_Qz} = \sum_{n=1}^{N} s * \text{W_n} * \text{G_n}, Qz \tag{5}$$

In order to update the control filters W_1 to W_N so as to minimize the evaluation function J, the control filters W_1 to W_N may be updated along the negative direction of the gradient of the evaluation function J with respect to the control filters W_1 to W_N. For example, a gradient ∂J/∂w_n of the evaluation function J with respect to the control filter W_n can be expressed by the following expression. Note that sgn(p_Vm) and sgn(p_Qz) in the expression are sign functions.

$$\frac{\partial J}{\partial \text{W_n}} = 2ej\left(\frac{1}{M}\sum_{m=1}^{M}\text{sgn}(\text{p_Vm})\cdot s(t) * \text{G_n}, Vm - \frac{1}{Z}\sum_{z=1}^{Z}\text{sgn}(\text{p_Qz})\cdot s(t) * \text{G_n}, Qz\right) \tag{6}$$

When the sound field filter G_n,Vm^ are substituted for the sound field characteristics G_n,Vm, and the sound field filters G_n and Qz^ are substituted for the sound field characteristics G_n and Qz, an update expression for the control filter W_n can be expressed by the following expression. In the expression, $\mu_w$ in the expression is a step size parameter.

$$\text{W_n}(t+1) = \text{W_n}(t) - 2\mu_w ej(t)\left(\frac{1}{M}\sum_{m=1}^{M}\text{sgn}(\text{p_Vm}(t)) \times s(t) * \text{G_n}, Vm\hat{}(t) - \frac{1}{Z}\sum_{z=1}^{Z}\text{sgn}(\text{p_Qz}(t)) \times s(t) * \text{G_n}, Qz\hat{}(t)\right) \tag{7}$$

The evaluation function J can also be set as follows.

$$J = ej^2 = \left(\frac{1}{M}\sum_{m=1}^{M}\text{p_Vm}^2 - \frac{1}{Z}\sum_{z=1}^{Z}\text{p_Qz}^2 - D\right)^2 \tag{8}$$

When the evaluation function J becomes minimum (J=0), the difference between the average value of the acoustic energy in the viewing area V and the average value of the acoustic energy in the quiet areas Q becomes the predetermined target value D. In this case, the update expression for the control filter W_n can be expressed by the following expression.

$$W_n(t+1) = W_n(t) - 2\mu_w ej(t)\left(\frac{1}{M}\sum_{m=1}^{M} p_Vm(t) \times s(t) * G_n, Vm\hat{}(t) - \frac{1}{Z}\sum_{z=1}^{Z} p_Qz(t) \times s(t) * G_n, Qz\hat{}(t)\right) \quad (9)$$

By minimizing the evaluation function J of the above expression (4), the difference between the average value of the sound pressure in the viewing area V and the average value of the sound pressure in the quiet areas Q can be brought closer to the predetermined target value D. Further, by minimizing the evaluation function J of the above expression (8), the difference between the average value of the acoustic energy of the viewing area V and the average value of the acoustic energy of the quiet areas Q can be brought closer to the predetermined target value D. However, the sound pressure itself in the viewing area V is not limited.

Therefore, the sizes of the control filters W_1 to W_N may be limited such that the sound pressure in the viewing area V does not become excessive. For example, the size of the control filter W_n is limited as follows. In the expression, η is an attenuation coefficient, and 0<η<1. In the expression, Wth denotes a predetermined threshold value.

$$\text{If } |W_n(t)|^2 > Wth, \text{ Then } W_n(t) = W_n(t) \times \eta \quad (10)$$

$$|W_n(t)|^2 = W_n^T W_n$$

The respective estimated detection sound signal generating units 30 perform signal processing on the control signals u_1 to u_N by sound field filters G_1^ to G_N^ to generate estimated detection sound signals y_1^ to y_N^.

The respective signal extraction units 32 extract components of the reproduced sounds output from the speakers 14 from the detection sound signals p_V1 to p_VM and p_Q1 to p_QZ detected by the microphones 20 and output the extracted components as target detection sound signals h_1 to h_N.

For example, the detection sound signal p_Vm detected by the Vm-th microphone 20 is generated in accordance with a synthetic sound obtained by synthesizing the reproduced sounds output from the first to N-th speakers 14 at the position of the Vm-th microphone 20. Therefore, for example, a component p_Vm,n of the reproduced sound output from the n-th speaker 14 among the detection sound signals p_Vm can be obtained by the following expression.

$$p_Vm, n = p_Vm - \sum_{n=1, i \neq n}^{N} s * W_n * G_n, Vm \quad (11)$$

Here, when the sound field function G_n,Vm^ is substituted for the sound field filter G_n,Vm, the component p_Vm,n can be obtained by the following expression.

$$p_Vm, n = p_Vm - \sum_{n=1, i \neq n}^{N} s * W_n * G_n, Vm\hat{} \quad (12)$$

The target detection sound signals h_1 to h_N can be expressed by vectors. For example, h_n can be expressed as follows.

$$h_n = [p_V1,n, p_V2,n, \ldots, p_VM,n, p_Q1,n, p_Q2,n, \ldots, p_QZ,n] \quad (13)$$

The respective differential signal generating units 34 generate differential signals d_1 to d_N based on the estimated detection sound signals y_1^ to y_N^ and the target detection sound signals h_1 to h_N.

Each of the differential signal generating units 34 includes an inverting amplifier 34*a* and an adder 34*b*. The estimated detection sound signals −y_1^ to −y_N^whose polarities are inverted by the respective inverting amplifiers 34*a* and the target detection sound signals h_1 to h_N are added by the adders 34*b* to generate the differential signals d_1 to d_N.

The respective sound field filter updating units 36 update the sound field filters G_1^ to G_N^ based on the control signals u_1 to u_N and the differential signals d_1 to d_N. For example, the sound field filter G_n,Vm^ is updated such that the following evaluation function I is minimized.

$$I = ei^2 = \left(p_Vm - \sum_{n=1, i \neq n}^{N} s * W_n * G_n, Vm\hat{} - s * W_n * G_n, Vm\hat{}\right)^2 \quad (14)$$

In order to update the sound field filters G_1^ to G_N^ such that the evaluation function I is minimized, the sound field filters G_1^ to G_N^ may be adaptively updated along the negative direction of the gradient of the evaluation function I with respect to the sound field filters G_1^ to G_N^. For example, an update expression for the sound field filter G_1^,Vm^ can be expressed by the following expression. In the expression, $\mu_c$ is the step size parameter.

$$G_n, Vm\hat{}(t+1) = G_n, Vm\hat{}(t) + 2\mu_G ei(t) \times s(t) * W_n(t) \quad (15)$$

Advantageous Effects

Figure 3A:
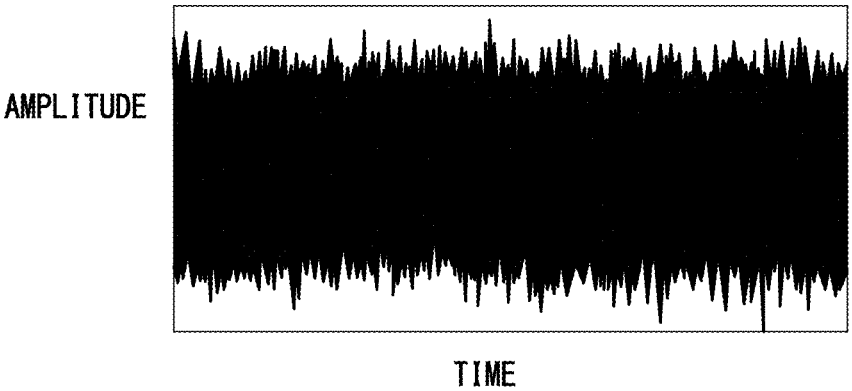
FIGS. 3A and 3B are graphs each illustrating changes over time of a sound signal detected by a microphone.
Figure 3B:
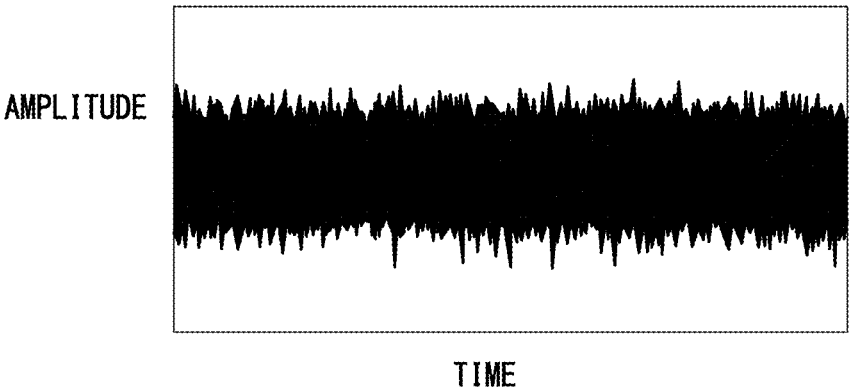

FIGS. 3A and 3B are graphs each showing changes over time of a detection sound signal detected by the microphone 20 installed in the viewing area V and the microphone 20 installed in the quiet area Q when the sound control of the present embodiment is OFF. FIG. 3A is a graph illustrating changes over time of a detection sound signal detected by the microphone 20 installed in the viewing area V. FIG. 3B is a graph illustrating changes over time of a detection sound signal detected by the microphone 20 installed in the quiet area Q.

Figure 4A:
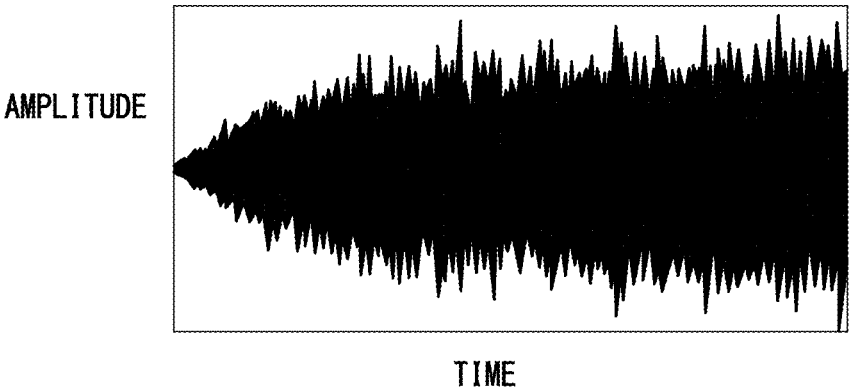
FIGS. 4A and 4B are graphs each illustrating changes over time of a sound signal detected by the microphone.
Figure 4B:
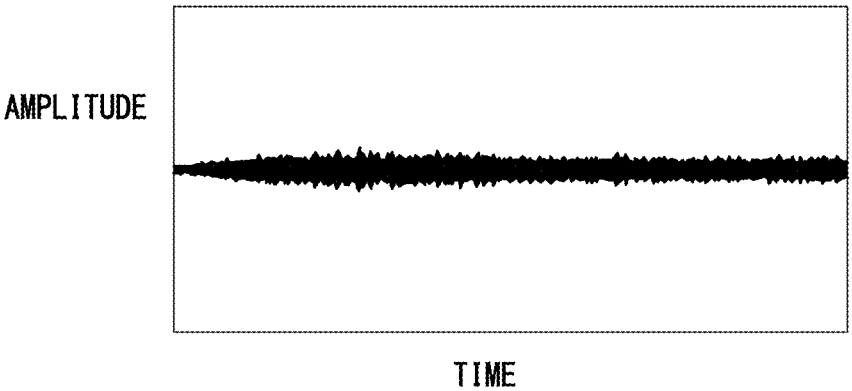

FIGS. 4A and 4B are graphs each showing changes over time of a detection sound signal detected by the microphone 20 installed in the viewing area V and the microphone 20 installed in the quiet area Q when the sound control of the present embodiment is ON. FIG. 4A is a graph illustrating changes over time of a detection sound signal detected by the microphone 20 installed in the viewing area V. FIG. 4B is a graph illustrating changes over time of a detection sound signal detected by the microphone 20 installed in the quiet area Q.

As shown in FIGS. 3A and 3B, when the sound control is OFF, the difference between the amplitude of the detection sound signals detected by the microphones 20 installed in the viewing area V and the amplitude of the detection sound signals detected by the microphones 20 installed in the quiet areas Q is small. On the other hand, as shown in FIGS. 4A and 4B, when the sound control is ON, the difference between the amplitude of the detection sound signals detected by the microphones 20 installed in the viewing area V and the amplitude of the detection sound signals detected by the microphones 20 installed in the quiet areas Q is large.

Figure 5:
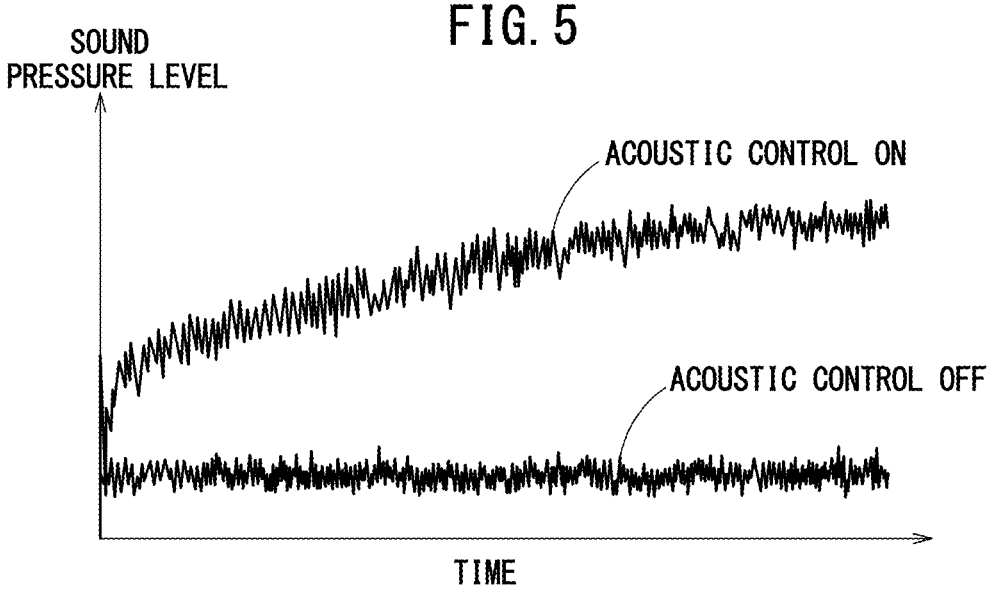
FIG. 5 is a graph illustrating changes over time of the difference between the sound pressure of the viewing area and the sound pressure of the quiet area.

FIG. 5 is a graph illustrating changes over time of the difference between the sound pressure of the viewing area V and the sound pressure of the quiet areas Q; As shown in FIG. 5, when the sound control is OFF, the change in the difference between the sound pressure of the viewing area V and the sound pressure of the quiet areas Q is small even as time elapses. On the other hand, when the sound control is ON, the difference between the sound pressure of the viewing area V and the sound pressure of the quiet areas Q increases with time.

Since it takes time until the control filters W_1 to W_N converge after the acoustic control is started, as illustrated in FIG. 5, a difference between the sound pressure of the viewing area V and the sound pressure of the quiet areas Q is small immediately after the acoustic control is started. This can be improved by setting initial values of the control filters W_1 to W_N.

Assuming that the number of speakers 14 is N, the number of microphones 20 in the viewing area V is M, and the number of microphones 20 in the quiet areas Q is Z, the acoustic control device 10 of the present embodiment requires N control filters W_1 to W_N and requires N×(M+Z) sound field filters G_1^ to G_N^.

In the acoustic control device 10 of the present embodiment, the sound field filter updating unit 36 learns the sound field characteristics G_1 to G_N as the sound field filters G_1^ to G_N^. Therefore, even when the sound field characteristics G_1 to G_N change, it is possible to make the sound field filters G_1^ to G_N^ follow. Therefore, even when the sound field characteristics G_1 to G_N change, it is possible to maintain the performance of acoustic control.

Further, in the acoustic control device 10 of the present embodiment, the control filter updating unit 28 sequentially and adaptively updates the control filters W_1 to W_N such that the difference between the average of the magnitudes (sound pressures) of the detection sound signals p_V1 to p_VM detected by the microphones 20 installed in the viewing area V and the average of the magnitudes (sound pressures) of the detection sound signals p_Q1 to p_QZ detected by the microphones 20 installed in the quiet areas Q, becomes the target value D. Thus, the sound pressures in the quiet areas Q can be made smaller than the sound pressure in the viewing area V.

Each of the sound field characteristic learning units 37 of the acoustic control device 10 according to the present embodiment includes a signal extraction unit 32. The respective signal extracting units 32 extract components of the reproduced sounds output from the speakers 14 from the detection sound signals p_V1 to p_VM and p_Q1 to p_QZ detected by the microphones 20 and output the extracted components as target detection sound signals h_1 to h_N. Accordingly, the respective sound field characteristic learning units 37 can generate the sound field filters G_1^ to G_N^based on the components (the target detection sound signals h_1 to h_N) of the reproduced sounds output from the respective speakers 14. Therefore, it is possible to increase the learning accuracy of the sound field characteristics.

Second Embodiment

Figure 6:
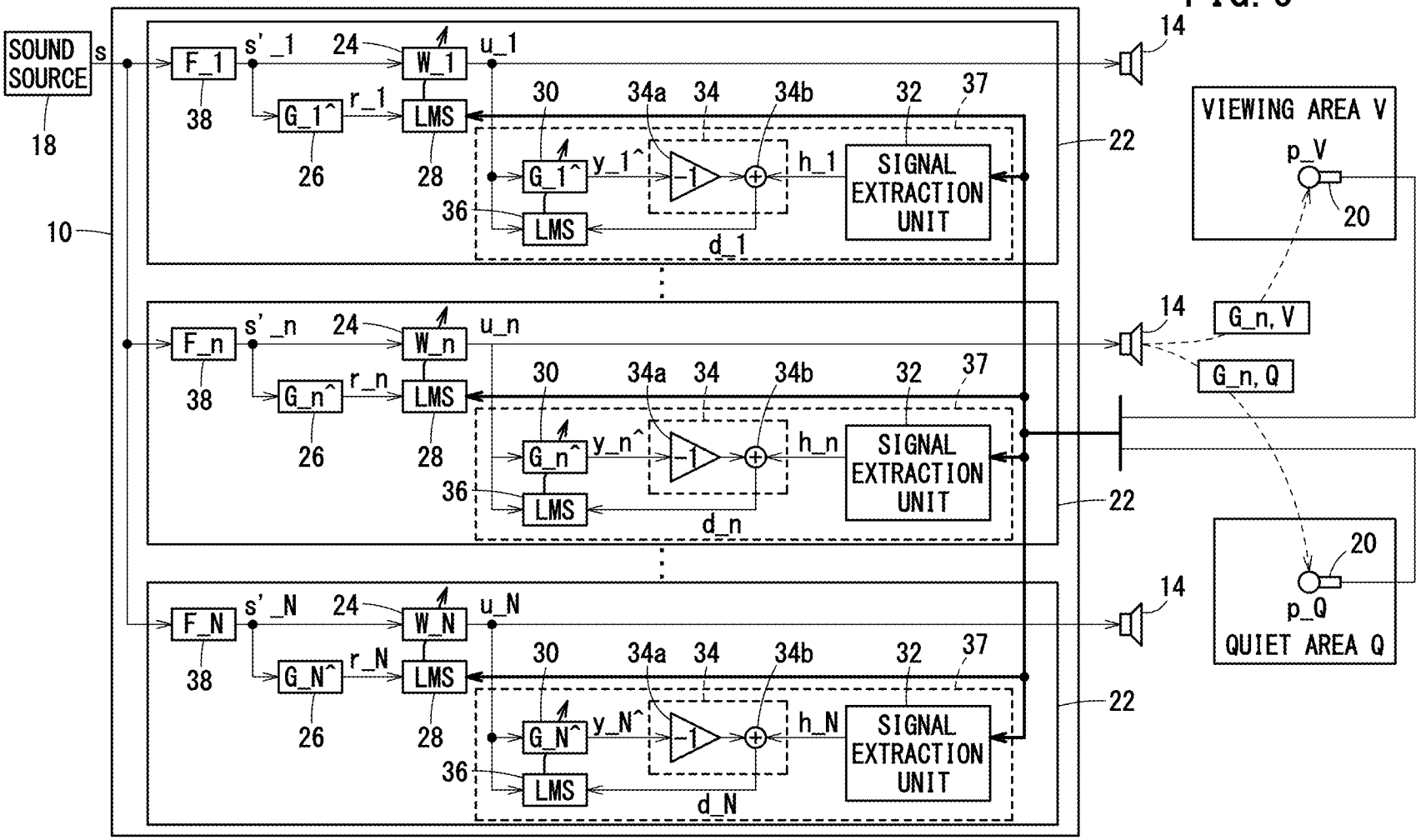
FIG. 6 is a control block diagram of the acoustic control device.

FIG. 6 is a control block diagram of the acoustic control device 10. The acoustic control device 10 according to the present embodiment is different from the acoustic control device 10 according to the first embodiment in that a corrected sound source signal generating unit 38 is provided in each signal processing unit 22.

In the present embodiment, it is assumed that My viewing areas V are set and one microphone 20 is installed in each viewing area V. In addition, it is assumed that Zq quiet areas Q are set and one microphone 20 is installed in each quiet area Q.

The respective corrected sound source signal generating units 38 perform signal processing on the sound source signal s using fixed filters F_1 to F_N to generate corrected sound source signals s'_1 to s'_N.

The respective fixed filters F_1 to F_N are set according to sound field characteristic G_V between the speakers 14 and grid points set in the viewing areas V and sound field characteristic G_Q between the speakers 14 and grid points set in the quiet areas Q.

When the target area of acoustic control in the vehicle compartment 16 is divided using a grid and M grid points are set, the sound field characteristic G can be expressed by the following matrix.

$$G = \begin{bmatrix} \mathrm{G_1,1} & \dots & \mathrm{G_1},M \\ \vdots & \ddots & \vdots \\ \mathrm{G_N,1} & \dots & \mathrm{G_N},M \end{bmatrix} \tag{16}$$

Elements corresponding to each grid point in the viewing area V are extracted from the sound field characteristic G to set a matrix G_V, and elements corresponding to each grid point in the quiet area Q are extracted to set a matrix G_Q.

The acoustic energy Eω_V of a frequency ω in the viewing areas V can be expressed by the following expression. In the expression, H denotes a conjugate transpose.

$$E\omega_\mathrm{V} \propto \sum_{m=1}^{Mv} p\omega_\mathrm{Vm}^2 = F\omega^H G\omega_\mathrm{V}^H G\omega_\mathrm{V} F\omega \tag{17}$$

That is, the acoustic energy Eω_V can be expressed in a matrix form indicating the sum of the squares of the sound pressure. The acoustic energy Eω_Q of the frequency ω in the quiet area Q can be expressed similarly.

The frequency characteristic Fω at the frequency ω is set such that a following evaluation function K becomes maximum.

$$K = \frac{\mathrm{E}\omega_\mathrm{V}}{\mathrm{E}\omega_\mathrm{Q}} = \frac{F\omega^H \mathrm{G}\omega_\mathrm{V}^H \mathrm{G}\omega_\mathrm{V}\mathrm{F}\omega}{F\omega^H \mathrm{G}\omega_\mathrm{Q}^H \mathrm{G}\omega_\mathrm{Q}\mathrm{F}\omega} \tag{18}$$

The frequency characteristic Fω is an eigenvector corresponding to the maximum eigenvalue of the matrix $\mathrm{G}\omega_\mathrm{V}^H \mathrm{G}\omega_\mathrm{V}[\mathrm{G}\omega_\mathrm{Q}^H \mathrm{G}\omega_\mathrm{Q}]^{-1}$. Each frequency characteristic Fω is obtained for all frequencies of a control object, and fixed filters F_1 to F_N are obtained by performing inverse fast Fourier transform on each frequency characteristic Fω.

An update expression for the control filter W_n updated in the control filter updating unit 28 can be expressed by the following expression. In the expression, $\mu_g$ in the expression is a step size parameter.

$$W_n(t+1) = W_n(t) - 2\mu_w ej(t)\left(\frac{1}{Mv}\sum_{m=1}^{Mv} \mathrm{sgn}(p_Vm(t)) \times s(t) * F_n * G_n, Vm\hat{}(t) - \frac{1}{Zq}\sum_{z=1}^{Zq} \mathrm{sgn}(p_Qz(t)) \times s(t) * F_n * G_n, Qz\hat{}(t)\right) \quad (19)$$

In the expression, ej(t) is expressed by the following expression.

$$ej(t) = \frac{1}{M}\sum_{m=1}^{M} |p_Vm(t)| - \frac{1}{Z}\sum_{z=1}^{Z} |p_Qz(t)| - D \quad (20)$$

In the expression, D is a predetermined target value of a difference between an average value of sound pressure in the viewing areas V and an average value of sound pressure in the quiet areas Q.

An update expression for the sound field filters G_n,Vm^ updated by the sound field filter updating unit 36 can be expressed by the following expression. In the expression, $\mu_G$ is a step size parameter.

$$G_n, Vm\hat{}(t+1) = G_n, Vm\hat{}(t) + 2\mu_G \times ei(t) \times s(t) * F_n * W_n(t) \quad (21)$$

In the above expression, ei(t) is expressed by the following expression.

$$ei(t) = p_Vm(t) - \sum_{n=1, i \neq n}^{N} s(t) * W_n(t) * G_n, Vm\hat{}(t) - s(t) * W_n(t) * G_n, Vm\hat{}(t)$$

Advantageous Effects

Figure 7A:
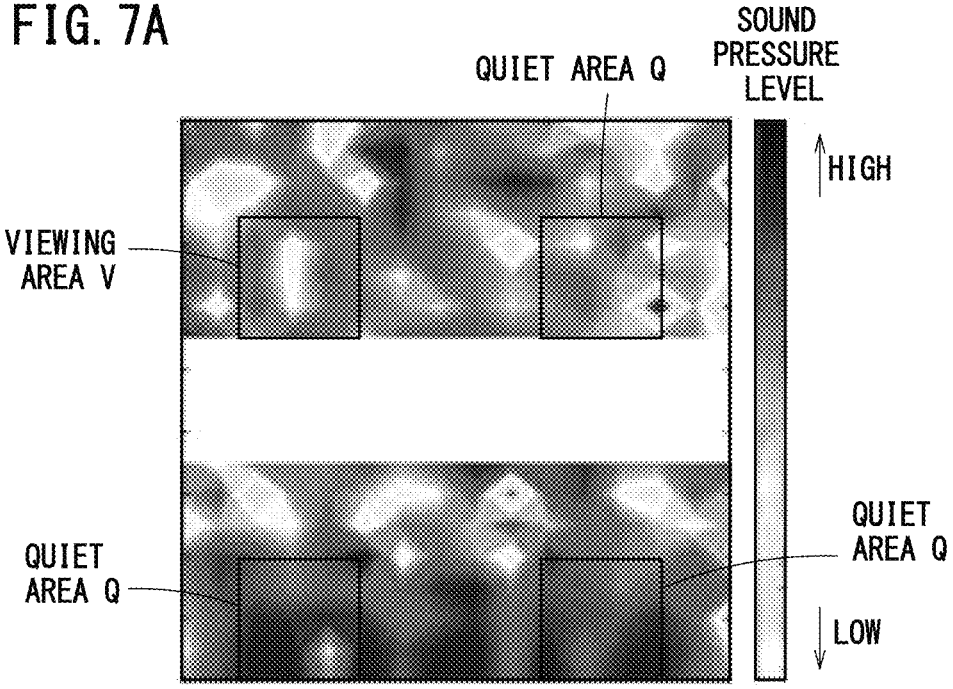
FIGS. 7A and 7B are diagrams each illustrating a distribution of sound pressure in the vehicle compartment.
Figure 7B:
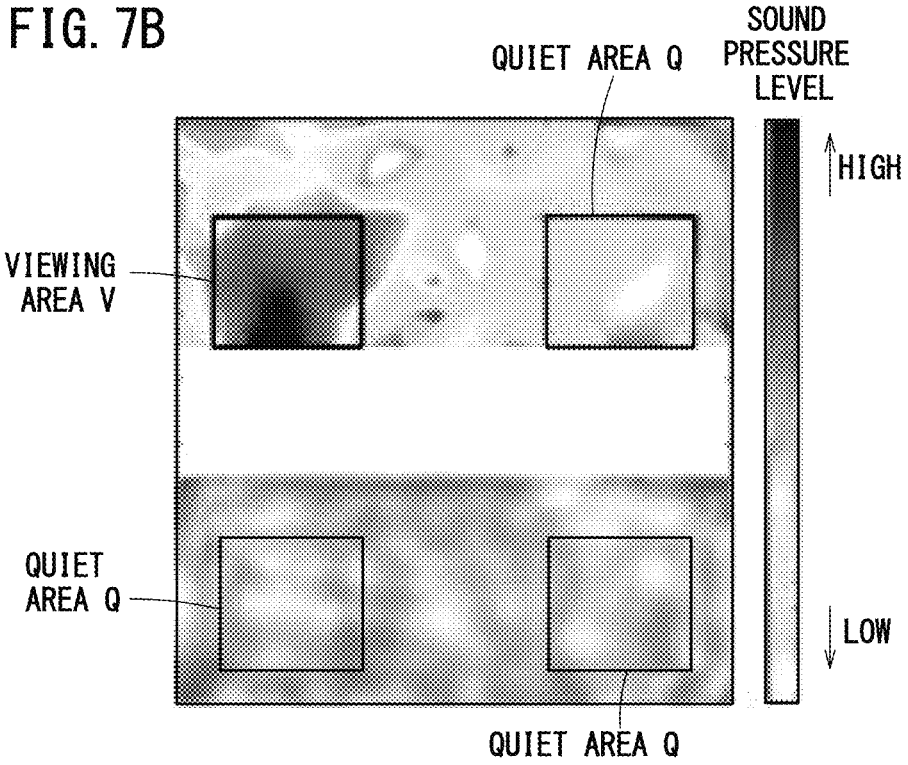

FIGS. 7A and 7B are diagrams illustrating the distribution of sound pressure levels in the vehicle compartment 16. The darker the color is, the higher the sound pressure level is. FIG. 7A shows the distribution of sound pressure level in the vehicle compartment 16 when the acoustic control according to the present embodiment is OFF. FIG. 7B shows the distribution of sound pressure level in the vehicle compartment 16 when the acoustic control according to the present embodiment is ON.

As shown in FIG. 7A, when the acoustic control according to the present embodiment is OFF, the sound pressure levels in the viewing area V and the quiet areas Q are high. On the other hand, as shown in FIG. 7B, when the sound control according to the present embodiment is ON, the sound pressure level in the viewing area V is high, but the sound pressure levels in the quiet areas Q are low.

Assuming that the number of speakers 14 is N, the number of viewing areas V is Mv, the number of quiet areas Q is Zq, and one microphone 20 is provided in each of the viewing areas V and the quiet areas Q, the acoustic control device 10 according to the present embodiment requires N control filters W_1 to W_N and requires N×(Mv+Zq) sound field filters G_1^ to G_N^.

As a result, the number of microphones 20 per viewing area V and quiet area Q can be reduced, and the configuration of the acoustic control device 10 can be simplified. In addition, the range of acoustic control per microphone 20 can be expanded.

Third Embodiment

Figure 8:
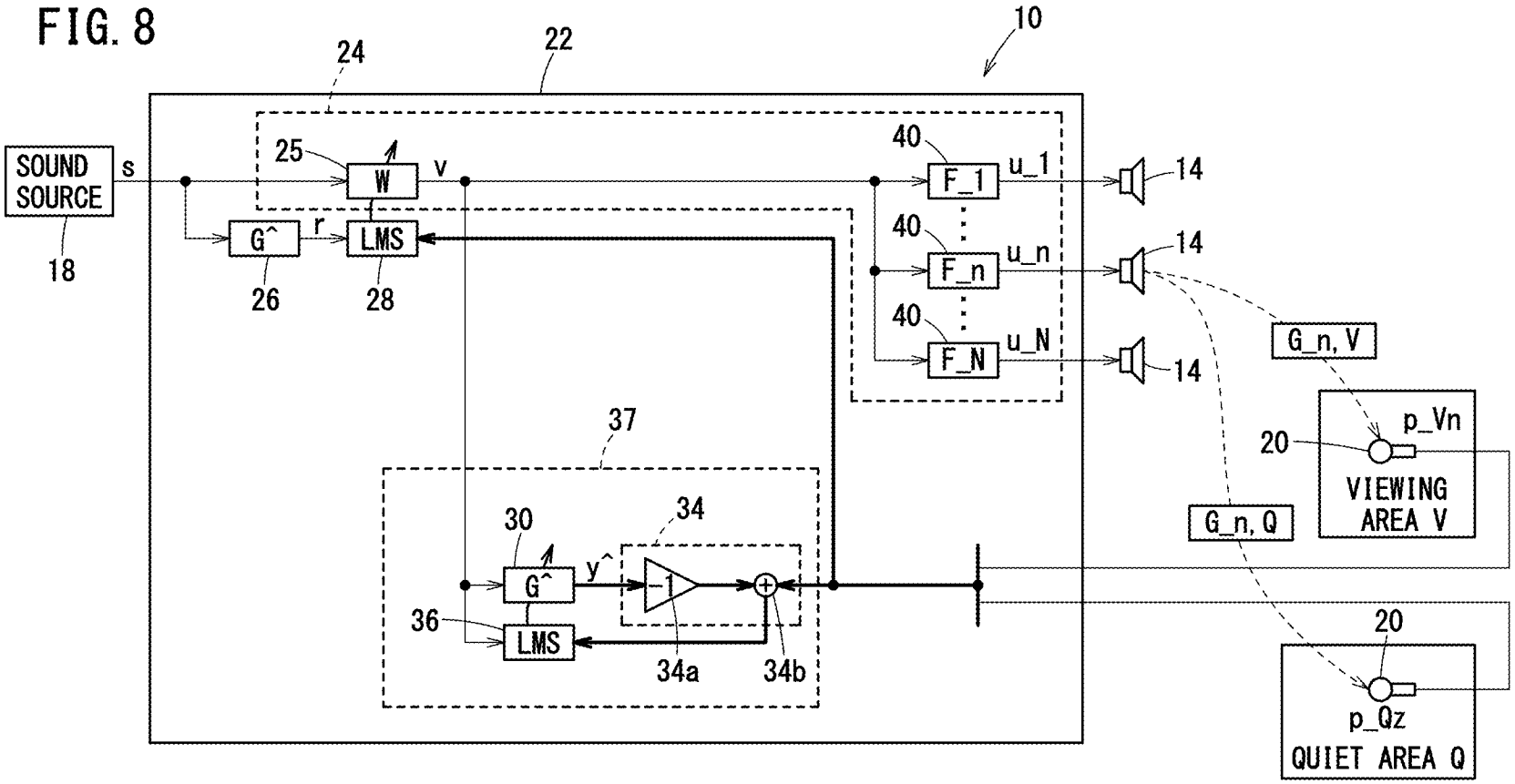
FIG. 8 is a control block diagram of the acoustic control device.

FIG. 8 is a control block diagram of an acoustic control device 10. In the present embodiment, a common signal processing unit 22 is provided for N speakers 14. A control signal generating unit 24 of the signal processing unit 22 includes a common signal generating unit 25 and a control signal correcting unit 40.

The single common signal generating unit 25 is provided for the N speakers 14. The common signal generating unit 25 performs signal processing on a sound source signal s by a control filter W to generate a common control signal v.

Each control signal correcting unit 40 is provided one by one for each of the N speakers 14. The respective control signal correcting units 40 perform signal processing on the common control signal v by fixed filters F_1 to F_N to generate control signals u_1 to u_N. The method of obtaining the fixed filters F_1 to F_N is the same as that in the second embodiment.

In the present embodiment, it is assumed that My viewing areas V are set and one microphone 20 is installed in each viewing area V. In addition, it is assumed that Zq quiet areas Q are set and one microphone 20 is installed in each quiet area Q.

An update expression for the control filter W updated by the control filter updating unit 28 can be expressed as follows.

$$W(t+1) = W_n(t) - 2\mu_w ej(t)\left(\frac{1}{Mv}\sum_{m=1}^{Mv} \mathrm{sgn}(p_Vm(t)) \times s(t) * G_n, Vm\hat{}(t) - \frac{1}{Zq}\sum_{z=1}^{Zq} \mathrm{sgn}(p_Qz(t)) \times s(t) * G_n, Qz\hat{}(t)\right) \quad (23)$$

In the expression, ej(t) is expressed by the following expression.

$$ej(t) = \frac{1}{M}\sum_{m=1}^{M} |p_Vm(t)| - \frac{1}{Z}\sum_{z=1}^{Z} |p_Qz(t)| - D \quad (24)$$

In the expression, D is a predetermined target value of a difference between an average value of sound pressure in the viewing areas V and an average value of sound pressure in the quiet areas Q.

An update expression for the sound field filter G^ updated by the sound field filter updating unit 36 can be expressed as follows.

$$G\hat{}(t+1) = G\hat{}(t) + 2\mu_G ei(t) \times s(t) * W(t) \quad (25)$$

In the above expression, ei(t) is expressed by the following expression.

$$ei(t) = p_Vm(t) - \sum_{n=1, i \neq n}^{N} s(t) * W_n(t) * G_n, Vm\hat{}(t) - s(t) * W_n(t) * G_n, Vm\hat{}(t) \quad (26)$$

By updating the sound field filter Gˆ based on this expression, the sound field filter Gˆ converges to an equivalent sound field characteristic Geq.

Figure 9A:
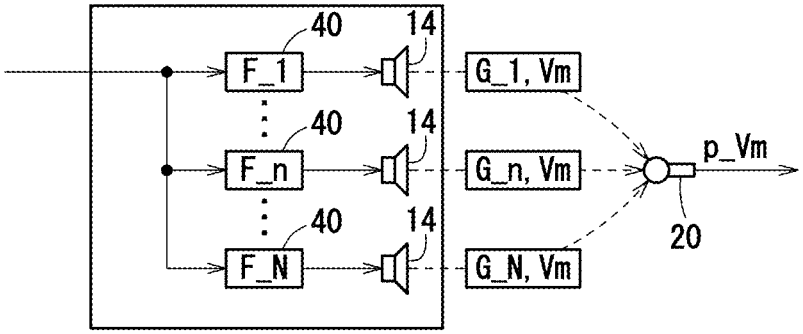
FIGS. 9A and 9B are diagrams each illustrating an equivalent sound field characteristic.
Figure 9B:
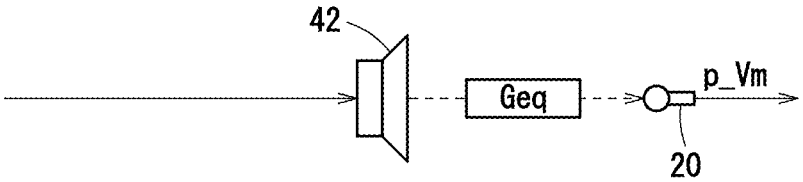

FIGS. 9A and 9B are diagrams illustrating the equivalent sound field characteristic Geq. As illustrated in FIG. 9A, sound transfer paths between the speakers 14 and the Vm-th microphone 20 have sound field characteristics G_1,Vm to G_N,Vm. As illustrated in FIG. 9B, when a combination of the fixed filters F_1 to F_N and the N speakers 14 is set as one virtual speaker 42, the sound field characteristic of a transfer path between the virtual speaker 42 and the Vm-th microphone 20 can be expressed by the equivalent sound field characteristic Geq.

Advantageous Effects

In the acoustic control device 10 according to the present embodiment, a common signal processing unit 22 is provided for the plurality of speakers 14. The signal processing unit 22 generates the common control signal v, and the control signal correcting units 40 provided corresponding to the speakers 14 perform signal processing on the common control signal v by the fixed filters F_1 to F_N to generate the control signals u_1 to u_N. Thus, in the signal processing unit 22, it is adequate that the single control filter W and the single sound field filter Gˆ are provided. That is, in the acoustic control device 10 according to the present embodiment, the number of control filters W and sound field filters Gˆ, each of which needs to be updated, can be reduced, and thus the amount of calculation in acoustic control can be reduced.

[Technical Concepts Obtained from Embodiments]

A description will be given below concerning technical concepts that are capable of being grasped from the above-described embodiments.

The acoustic control device (10) that controls the plurality of speakers (14) in order for a sound pressure in the quiet area (Q) to become lower than a sound pressure in the viewing area (V), based on a sound source signal output from the sound source (18), the acoustic control device including the sound detectors (20) each configured to detect a sound in an installed area and output a detection sound signal, at least one of the sound detectors installed in the viewing area and at least one of the sound detectors installed in the quiet area, the control signal generating unit (24) configured to perform signal processing on the sound source signal by a control filter, which is an adaptive finite impulse response filter, to generate a control signal that controls the speakers, the sound field characteristic learning unit (37) configured to learn as a sound field filter a sound field characteristic between the speakers and the sound detectors, the reference signal generating unit (26) configured to perform signal processing on the sound source signal by the sound field filter to generate a reference signal, and the control filter updating unit (28) configured to update sequentially and adaptively the control filter based on the reference signal and the detection sound signal in a manner that a difference between the sound pressure in the viewing area and the sound pressure in the quiet area becomes a predetermined level.

In the acoustic control device, the plurality of sound detectors may be installed in the viewing area and the plurality of sound detectors may be installed in the quiet area, and the control filter updating unit may be configured to update sequentially and adaptively the control filter in a manner that a difference between an average of magnitudes of the detection sound signals detected by the plurality of sound detectors installed in the viewing area and an average of magnitudes of the detection sound signals detected by the plurality of sound detectors installed in the quiet area becomes a predetermined level.

In the acoustic control device, the sound field characteristic learning unit may include the estimated detection sound signal generating unit (30) configured to perform signal processing on the control signal corresponding to each of the speakers by the sound field filter corresponding to each of the speakers and each of the sound detectors to generate an estimated detection sound signal corresponding to each of the speakers and each of the sound detectors, the signal extraction unit (32) configured to extract the detection sound signal corresponding to a sound output from each of the speakers from the detection sound signals detected by the respective sound detectors, to output a target detection sound signal, the differential signal generating unit (34) configured to generate a differential signal corresponding to each of the speakers and each of the sound detectors, from the target detection sound signal corresponding to each of the speakers and each of the sound detectors and the estimated detection sound signal corresponding to each of the speakers and each of the sound detectors, and the sound field filter updating unit (36) configured to update sequentially and adaptively the sound field filter corresponding to each of the speakers and each of the sound detectors based on the control signal corresponding to each of the speakers and the differential signal corresponding to each of the speakers and each of the sound detectors in a manner that the differential signal is minimized.

The acoustic control device may further include the corrected sound source signal generating unit (38) configured to perform signal processing on the detection sound signal by a fixed filter that is set in advance in accordance with a sound field characteristic between each of the speakers and a grid point set in the viewing area and a sound field characteristic between each of the speakers and a grid point set in the quiet area, to generate a corrected sound source signal, wherein the control signal generating unit may be configured to perform signal processing on the corrected sound source signal by the control filter to generate the control signal, and the reference signal generating unit may be configured to perform signal processing on the corrected sound source signal by the sound field filter to generate the reference signal.

In the acoustic control device, the control signal generating unit may include the common signal generating unit (25) installed corresponding to the plurality of speakers in common and the plurality of control signal correcting units (40) installed corresponding to the plurality of speakers, and the common signal generating unit may be configured to perform signal processing on the sound source signal by the control filter to generate a common control signal, and each of the control signal correcting units may be configured to perform signal processing on the common control signal by a fixed filter set in advance in accordance with a sound field characteristic to generate the control signal corresponding to each of the speakers.

The present invention is not particularly limited to the embodiments described above, and various modifications are possible without departing from the essence and gist of the present invention.

What is claimed is:

1. An acoustic control device that controls a plurality of speakers in order for a sound pressure in a quiet area to become lower than a sound pressure in a viewing area, based on a sound source signal output from a sound source, the acoustic control device comprising:

sound detectors each configured to detect a sound in an installed area and output a detection sound signal, at least one of the sound detectors installed in the viewing area and at least one of the sound detectors installed in the quiet area; and one or more processors that execute computer-executable instructions stored in a memory, wherein the one or more processors execute the computer-executable instructions to cause the acoustic control device to:

perform signal processing on the sound source signal by a control filter, which is an adaptive finite impulse response filter, to generate a control signal that controls the speakers;

learn as a sound field filter a sound field characteristic between the speakers and the sound detectors;

perform signal processing on the sound source signal by the sound field filter to generate a reference signal; and update sequentially and adaptively the control filter based on the reference signal and the detection sound signal in a manner that a difference between the sound pressure in the viewing area and the sound pressure in the quiet area becomes a predetermined level.

2. The acoustic control device according to claim 1, wherein a plurality of the sound detectors are installed in the viewing area and a plurality of the sound detectors are installed in the quiet area, and wherein the one or more processors cause the acoustic control device to update sequentially and adaptively the control filter in a manner that a difference between an average of magnitudes of the detection sound signals detected by the plurality of sound detectors installed in the viewing area and an average of magnitudes of the detection sound signals detected by the plurality of sound detectors installed in the quiet area becomes a predetermined level.

3. The acoustic control device according to claim 1, wherein the one or more processors cause the acoustic control device to:

perform signal processing on the control signal corresponding to each of the speakers by the sound field filter corresponding to each of the speakers and each of the sound detectors to generate an estimated detection sound signal corresponding to each of the speakers and each of the sound detectors;

extract the detection sound signal corresponding to a sound output from each of the speakers from the detection sound signals detected by the respective sound detectors, to output a target detection sound signal;

generate a differential signal corresponding to each of the speakers and each of the sound detectors, from the target detection sound signal corresponding to each of the speakers and each of the sound detectors and the estimated detection sound signal corresponding to each of the speakers and each of the sound detectors; and update sequentially and adaptively the sound field filter corresponding to each of the speakers and each of the sound detectors based on the control signal corresponding to each of the speakers and the differential signal corresponding to each of the speakers and each of the sound detectors in a manner that the differential signal is minimized.

4. The acoustic control device according to claim 1, wherein the one or more processors cause the acoustic control device to:

perform signal processing on the detection sound signal by a fixed filter that is set in advance in accordance with a sound field characteristic between each of the speakers and a grid point set in the viewing area and a sound field characteristic between each of the speakers and a grid point set in the quiet area, to generate a corrected sound source signal;

perform signal processing on the corrected sound source signal by the control filter to generate the control signal; and perform signal processing on the corrected sound source signal by the sound field filter to generate the reference signal.

5. The acoustic control device according to claim 1, wherein the one or more processors cause the acoustic control device to:

perform signal processing on the sound source signal by the control filter to generate a common control signal; and perform signal processing on the common control signal by a fixed filter set in advance in accordance with a sound field characteristic to generate the control signal corresponding to each of the speakers.

* * * * *